US011503419B2

(12) United States Patent
Mor et al.

(10) Patent No.: US 11,503,419 B2
(45) Date of Patent: Nov. 15, 2022

(54) DETECTION OF AUDIO PANNING AND SYNTHESIS OF 3D AUDIO FROM LIMITED-CHANNEL SURROUND SOUND

(71) Applicant: SPHEREO SOUND LTD., Rishon Lezion (IL)

(72) Inventors: Yoav Mor, Rishon Lezion (IL); David Mimouni, Holon (IL); Alon Rosenberg, Nes Tziona (IL); Hagay Konyo, Netanya (IL)

(73) Assignee: SPHEREO SOUND LTD., Ramat Gan (IL)

( * ) Notice: Subject to any disclaimer, the term of this patent is extended or adjusted under 35 U.S.C. 154(b) by 0 days.

(21) Appl. No.: 17/256,237

(22) PCT Filed: Jun. 26, 2019

(86) PCT No.: PCT/IB2019/055381
§ 371 (c)(1),
(2) Date: Dec. 28, 2020

(87) PCT Pub. No.: WO2020/016685
PCT Pub. Date: Jan. 23, 2020

(65) Prior Publication Data

US 2021/0136507 A1 May 6, 2021

Related U.S. Application Data

(60) Provisional application No. 62/699,749, filed on Jul. 18, 2018.

(51) Int. Cl.

| | |
|---|---|
| ***H04S 3/00*** | (2006.01) |
| ***G10L 19/008*** | (2013.01) |
| ***H04S 7/00*** | (2006.01) |

(52) U.S. Cl.
CPC ..... *H04S 3/00* (2013.01); *G10L 19/008* (2013.01); *H04S 2400/01* (2013.01); *H04S 2420/01* (2013.01)

(58) Field of Classification Search
CPC ..... G10L 19/008; H04S 3/00; H04S 3/004; H04S 3/002; H04S 3/008; H04S 7/00;
(Continued)

(56) References Cited

U.S. PATENT DOCUMENTS 5,371,799 A 12/1994 Lowe et al.
5,742,689 A 4/1998 Tucker et al.
(Continued)

FOREIGN PATENT DOCUMENTS

CN 201710428555 A 10/2017
JP H08107600 A 4/1996
(Continued)

OTHER PUBLICATIONS

Farge et al., "Wavelet transforms and their applications to turbulence", Annual Review of Fluid Mechanics, vol. 24, pp. 395-457, year 1992.
(Continued)

*Primary Examiner* — Leshui Zhang
(74) *Attorney, Agent, or Firm* — Kligler & Associates Patent Attorneys Ltd

(57) ABSTRACT

A method includes receiving a multi-channel audio signal (101) including multiple input audio channels (102, 104, 106, 108) that are configured to play audio from multiple respective locations relative to a listener. One or more spectral components that undergo a panning effect (1001, 1002, 1003) are identified in the multi-channel audio signal among at least some of the input audio channels. One or more virtual channels (1100, 1200, 1300) are generated, which together with the input audio channels form an
(Continued)

extended set (111) of audio channels that retain the identified panning effect. A reduced set (222) of output audio signals, fewer in number than the input audio signals, is generated from the extended set, including recreating the panning effect in the output audio signals. The reduced set of output audio signals is outputted to a user.

8 Claims, 4 Drawing Sheets

(58) Field of Classification Search
CPC . H04S 7/30; H04S 7/302; H04S 7/307; H04S 7/304; H04S 1/002; H04S 5/005; H04S 5/00; H04S 2400/01; H04S 2420/01
USPC ..... 700/500–504, 94; 381/1–23, 300–311, 381/26, 27, 56, 61, 62, 63, 320, 321, 74, 381/77, 80, 81, 82, 85, 86, 332, 333, 334, 381/97, 98, 99, 100, 101, 102, 103, 106, 381/111, 116, 117, 118, 119, 120, 123
See application file for complete search history.

(56) References Cited

U.S. PATENT DOCUMENTS

| | | | | |
|---|---|---|---|---|
| 6,421,446 | B1 | 7/2002 | Cashion et al. | |
| 6,498,857 | B1 | 12/2002 | Sibbald | |
| 7,167,567 | B1 | 1/2007 | Sibbald et al. | |
| 8,638,959 | B1 | 1/2014 | Hall | |
| 10,149,082 | B2 | 12/2018 | Fielder et al. | |
| 10,531,216 | B2 | 1/2020 | Mor et al. | |
| 2005/0047618 | A1 | 3/2005 | Davis et al. | |
| 2005/0273324 | A1 | 12/2005 | Yi | |
| 2006/0117261 | A1 | 6/2006 | Sim et al. | |
| 2006/0177078 | A1 | 8/2006 | Chanda et al. | |
| 2008/0232616 | A1 | 9/2008 | Pulkki et al. | |
| 2010/0191537 | A1 | 7/2010 | Breenbaart | |
| 2011/0116638 | A1* | 5/2011 | Son | H04S 3/008 381/1 |
| 2012/0020483 | A1 | 1/2012 | Desphande et al. | |
| 2012/0201405 | A1 | 8/2012 | Slamka et al. | |
| 2014/0355765 | A1 | 12/2014 | Kulavik et al. | |
| 2015/0063553 | A1 | 3/2015 | Gleim | |
| 2015/0205575 | A1* | 7/2015 | Kitazawa | G10L 21/0216 700/94 |
| 2015/0223002 | A1 | 8/2015 | Mehta et al. | |
| 2016/0007133 | A1 | 1/2016 | Mateos Sole et al. | |
| 2016/0066118 | A1 | 3/2016 | Oh et al. | |
| 2016/0337779 | A1 | 11/2016 | Davidson et al. | |
| 2017/0013389 | A1 | 1/2017 | Kitazawa | |

FOREIGN PATENT DOCUMENTS

| | | | |
|---|---|---|---|
| JP | 2007068022 | A | 3/2007 |
| JP | 2009065452 | A | 3/2009 |
| KR | 20100095542 | A | 8/2010 |
| WO | 99/31938 | A1 | 6/1999 |
| WO | 2014036121 | A1 | 3/2014 |

OTHER PUBLICATIONS

Watkins, "Psychoacoustical aspects of synthesized vertical locale cues", Journal Acoustical Society of America, vol. 63, No. 4, pp. 1152-1165, Apr. 1978.

Goupillaud et al., "Cycle-octave and related transforms in seismic signal analysis", Geoexploration, vol. 23, pp. 85-102, years 1984/1985.

Haar., "Zur Theorie der orthogonalen Funktionensysteme", Mathematische Annalen, vol. 69, issue 3, pp. 331-332, Sep. 1910.

Taplidou, "Nonlinear analysis of wheezes using wavelet bicoherence", Computers in Biology and Medicine, vol. 37, pp. 563-570, year 2007.

Taplidou et al., "Nonlinear characteristics of wheezes as seen in the wavelet higher-order spectra domain", Proceedings of the 28th IEEE EMBS Annual International Conference, New York, USA, pp. 4506-4509, Aug. 30-Sep. 3, 2006.

Van Milligen et al., "Wavelet bicoherence: A new turbulence analysis tool", Physics of Plasmas 2, vol. 8, pp. 3017-3032, Aug. 1995.

Von Tscharner, "Intensity analysis in time-frequency space of surface myoelectric signals by wavelets of specified resolution", Journal of Electromyography and Kinesiology, vol. 10, pp. 433-445, year 2000.

Von Tscharner, "Time-frequency and principal-component methods for the analysis of EMGs recorded during a mildly fatiguing exercise on a cycle ergometer", Journal of Electromyography and Kinesiology, vol. 12, pp. 479-492, year 2002.

Wang et al., "Optimising coherence estimation to assess the functional correlation of tremor-related activity between the subthalamic nucleus and the forearm muscles", Journal of Neuroscience Methods, vol. 136, pp. 197-205, year 2004.

Wang et al., "Time-frequency analysis of transient neuromuscular events: dynamic changes in activity of the subthalamic nucleus and forearm muscles related to the intermittent resting tremor", Journal of Neuroscience Methods, vol. 145, pp. 151-158, 2005.

Keyrouz et al., "Binaural source localization and spatial audio reproduction for telepresence applications" Presence: Teleoperators and Virtual Environments, vol. 16, No. 5, pp. 509-522, Sep. 30, 2007.

Susnik, "An elevation coding method for auditory displays", Applied Acoustics, vol. 69, issue 3, pp. 233-241, Mar. 2008.

Grinsted et al.,"Application of the cross wavelet transform and wavelet coherence to geophysical time series", Nonlinear Processes in Geophysics, vol. 11, pp. 561-566, 2004.

Maraun et al., "Cross wavelet analysis: significance testing and pitfalls", Nonlinear Processes in Geophysics , vol. 11, pp. 505-514, 2004.

Torrence et al., "A Practical Guide to Wavelet Analysis", Bulletin of the American Meteorological Society, vol. 79, pp. 67-78, 1998.

Von Tscharner et al., "Subspace Identification and Classification of Healthy Human Gait", PLOS One 8, vol. 8, issue 7, pp. 1-8, Jul. 2013.

Gardner et al., "HRTF Measurements of a KEMAR Dummy-Head Microphone", pp. 1-2, May 18, 1994.

Susnik et al .,"Coding of Elevation in Acoustic Image of Space", Proceedings of Acoustics, pp. 145-150, Nov. 9-11, 2005.

International Application # PCT/IB2019/055381 Search Report dated Oct. 3, 2019.

Psychoacoustics of Spatial Hearing—CIPIC International Laboratory, pp. 1-6, Feb. 25, 2011 http://interface.cipic/ucdavis.edu/sound/tutorial/psych.htm.

"A complete, cross-platform solution to record, convert and stream audio and video", FFmpeg, pp. 1-9, Sep. 29, 2015 (https://web.archive.org/web/20151201044636/https://www.ffmpeg.org/).

EP Application # 19838642.7 Search Report dated Mar. 23, 2022.

* cited by examiner

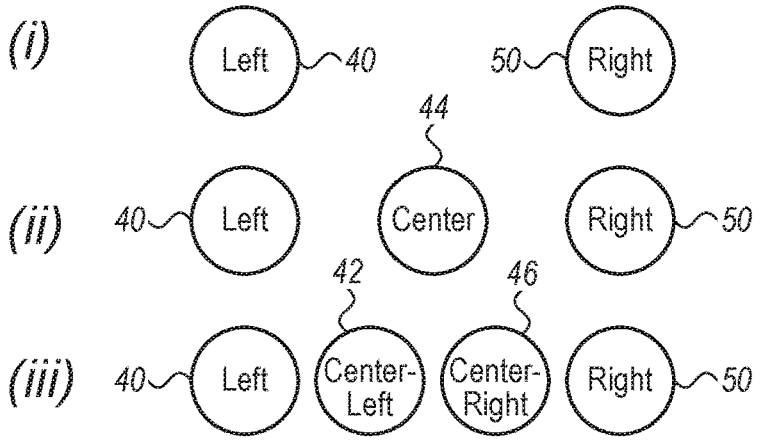
FIG. 7
FIG. 8
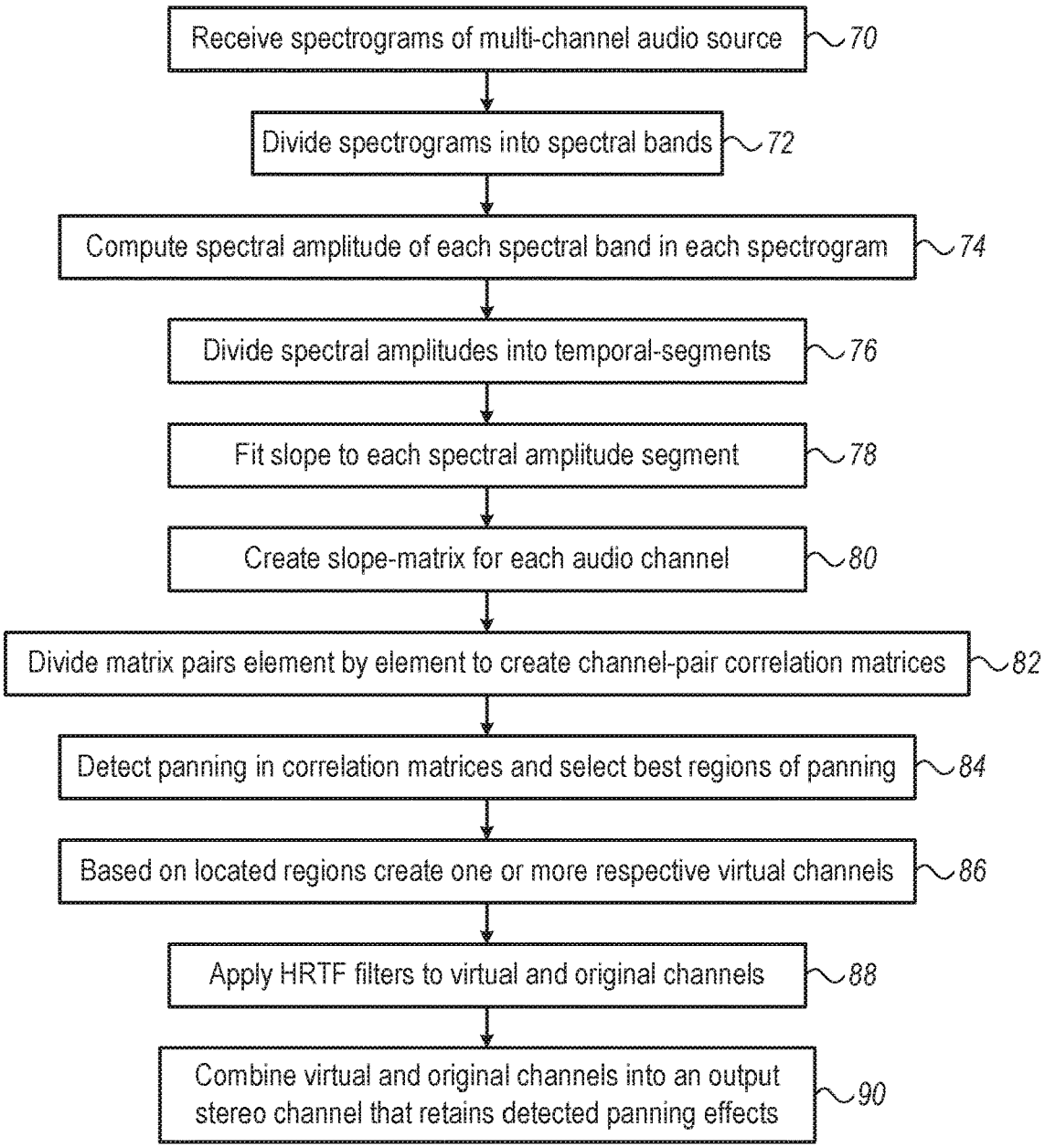

DETECTION OF AUDIO PANNING AND SYNTHESIS OF 3D AUDIO FROM LIMITED-CHANNEL SURROUND SOUND

CROSS-REFERENCE TO RELATED APPLICATIONS

This application claims the benefit of U.S. Provisional Patent Application 62/699,749, filed Jul. 18, 2018, whose disclosure is incorporated herein by reference.

FIELD OF THE INVENTION

The present invention relates generally to processing of audio signals, and particularly to methods, systems and software for generation and playback of audio output.

BACKGROUND OF THE INVENTION

Techniques for manipulating sound signals so as to affect user experience have been previously reported in the patent literature. For example, U.S. Patent Application Publication 2012/0201405 describes a combination of techniques for modifying sound provided to headphones to simulate a surround-sound loudspeaker environment with listener adjustments. In one embodiment, Head Related Transfer Functions (HRTFs) are grouped into multiple groups, with four types of HRTF filters or other perceptual models being used and selectable by a user. Alternately, a custom filter or perceptual model can be generated from measurements of the user's body, such as optical or acoustic measurements of the user's head, shoulders and pinna. Also, the user can select a loudspeaker type, as well as other adjustments, such as head size and amount of wall reflections.

As another example, U.S. Pat. No. 10,149,082 describes a method of generating one or more components of a binaural room impulse response (BRIR) for headphone virtualization. In the method, directionally-controlled reflections are generated, wherein directionally-controlled reflections impart a desired perceptual cue to an audio input signal corresponding to a sound source location. Then at least the generated reflections are combined to obtain the one or more components of the BRIR. Corresponding system and computer program products are described as well.

Chinese Patent Application Publication 2017/10428555 describes 3D sound field construction method and a virtual reality (VR) device. The construction method comprises the following steps: producing an audio signal containing sound source position information according to a position relation of a sound source and a listener; and restoring and reconstructing the 3D sound field space environment according to the audio signal containing the sound source position information. An output mode of a panoramic audio in the VR is realized, the 3D sound field is more real, the immersion on the sound is brought for the VR product, and the user experience is promoted.

SUMMARY OF THE INVENTION

An embodiment of the present invention provides a method including receiving a multi-channel audio signal including multiple input audio channels that are configured to play audio from multiple respective locations relative to a listener. One or more spectral components that undergo a panning effect are identified in the multi-channel audio signal among at least some of the input audio channels. One or more virtual channels are generated, which together with the input audio channels form an extended set of audio channels that retain the identified panning effect. A reduced set of output audio signals, fewer in number than the input audio signals, is generated from the extended set, including recreating the panning effect in the output audio signals. The reduced set of output audio signals is outputted to a user.

In some embodiments, generating the reduced set of output audio signals includes synthesizing left and right audio channels of a stereo signal.

In some embodiments, recreating the panning effect in the output audio signals includes applying directional filtration to the virtual channels and the multiple input audio channels.

In an embodiment, identifying the spectral components that undergo the panning effect includes (a) receiving or generating multiple spectrograms corresponding to the audio input channels, (b) dividing the spectrograms into spectral bands, (c) computing amplitude functions for the spectral bands of the spectrograms, each amplitude function giving an amplitude of a respective spectral hand in a respective spectrogram as a function of time, and (d) identifying one or more pairs of the amplitude functions exhibiting the panning effect.

In another embodiment, identifying the pairs includes identifying first and second amplitude functions, corresponding to a same spectral band in first and second spectrograms, wherein in the first amplitude function the amplitude increases monotonically over a time interval, and in the second amplitude function the amplitude decreases monotonically over the same time interval.

In some embodiments, dividing the spectrograms into the spectral bands includes producing at least two spectral bands having different bandwidths.

There is additionally provided, in accordance with an embodiment of the present invention, a system including an interface and a processor. The interface is configured to receive a multi-channel audio signal including multiple input audio channels that are configured to play audio from multiple respective locations relative to a listener. The processor is configured to (i) identify in the multi-channel audio signal one or more spectral components that undergo a panning effect among at least some of the input audio channels, (ii) generate one or more virtual channels, which together with the input audio channels form an extended set of audio channels that retain the identified panning effect, (iii) generate from the extended set a reduced set of output audio signals, fewer in number than the input audio signals, including recreating the panning effect in the output audio signals, and (iv) output the reduced set of output audio signals to a user.

The present invention will be more fully understood from the following detailed description of the embodiments thereof, taken together with the drawings in which:

BRIEF DESCRIPTION OF THE DRAWINGS

FIG. 7 is a diagram that schematically shows one or more virtual loudspeakers generated from two original audio channels, in accordance with an embodiment of the present invention; and FIG. 8 is a flow chart that schematically illustrates a method for generating a virtual loudspeaker that induces a psycho-acoustic feeling of direction and motion, in accordance with an embodiment of the present invention.

DETAILED DESCRIPTION OF EMBODIMENTS

Overview

Figure 1:
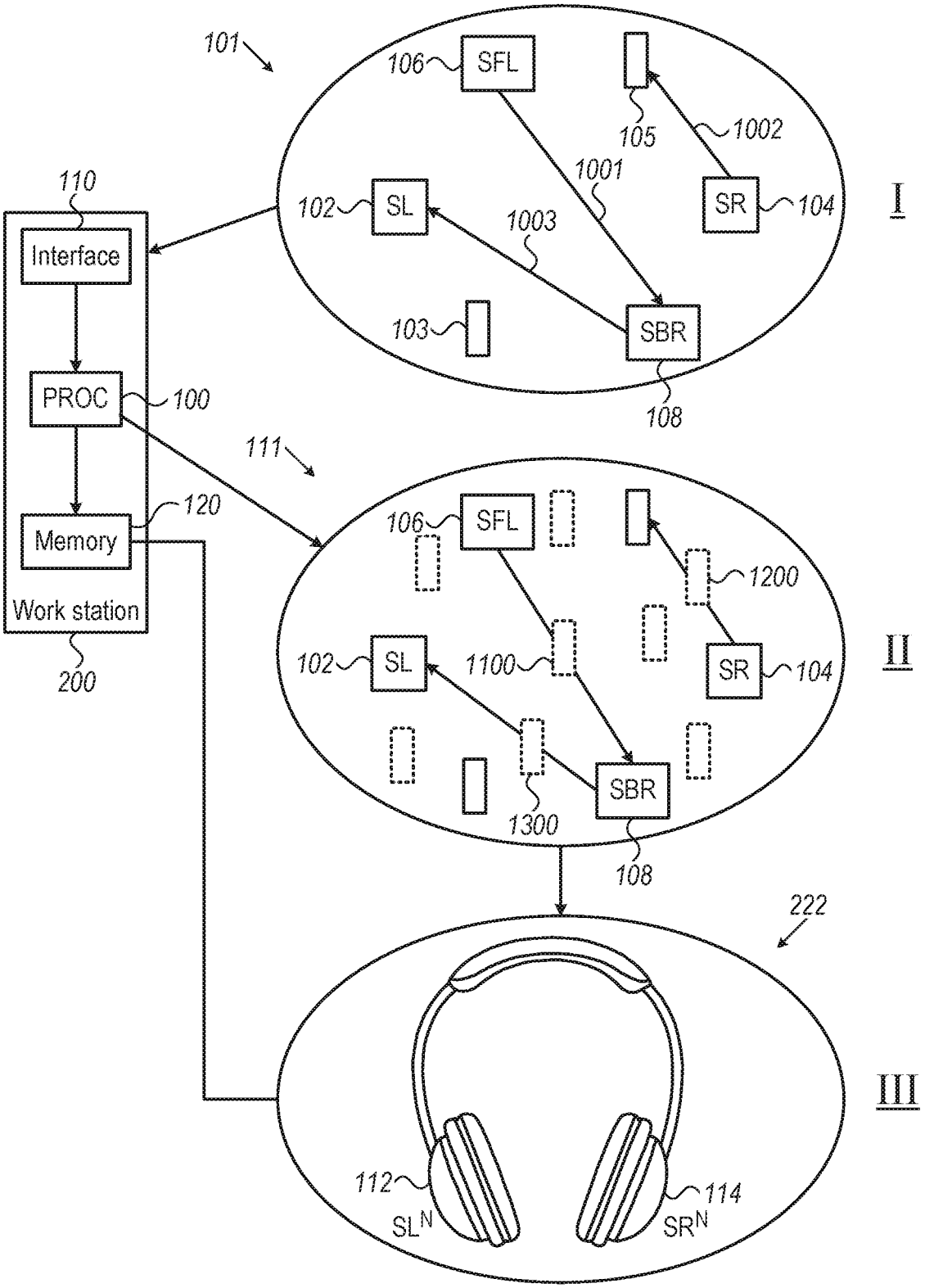
FIG. 1 is a schematic block diagram of a workstation configured to generate a limited-channel set-up comprising panning effects extracted from a multi-channel audio signal, in accordance with an embodiment of the present invention.

Audio recording and post-production processes allow for an "immersive surround sound" experience, particularly in movie theaters, where the listener is surrounded by a large number of loudspeakers, most typically twelve loudspeakers (known as 10.2 setup comprising ten loudspeakers and two subwoofers), and, in some cases, numbering above twenty. Surrounded by sound-emitting loudspeakers, the listener can be given the experience and sensation of motion and movement through audio panning between the different loudspeakers in the theater (i.e., gradually decreasing amplitude in one loudspeaker, while at the same time increasing the amplitude of another). To a somewhat lesser extent, home theaters, which most commonly comprise a 5.1 "surround" setup of loudspeakers (five loudspeakers and one subwoofer), also provide a psycho-acoustic feeling of motion and movement.

In contrast, many people today listen to audio (music, movies, games, etc.) using mobile devices, such as tablets and laptops, most commonly through headphones, which typically provide stereo (two-channel) audio only. The audio experience, being down-mixed to two channels only, loses most, if not all, of the motion-related information as planned by the producers and designers of the original audio content.

Some sense of the directionality experienced in listening to the original "surround" audio can be maintained through the use of Head-Related Transfer Functions (HRTF) filters, a specially created filter type obtained from special binaural recordings using head-shaped microphones, or microphones embedded within dummy heads.

However, simply applying HRTF filters to individual channels of a surround system, for example to a 5.1 audio mix, is insufficient for creating a full immersive experience. One of the reasons for this shortcoming is that the feeling of motion, created by sound engineers in multi-channel audio mixes (For example, using a method of "panning" audio from one loudspeaker to another) is insufficiently reproduced using a simple HRTF technique when applied to relatively small number of loudspeakers, such as in the case of the 5.1 "surround" setup.

Embodiments of the present invention that are described hereinafter provide methods that allow a user to experience, over two channels only, the full immersive sensation contained in the original multi-channel audio mix. The present technique typically applies the steps of first detecting and preserving information about audio panning at different audio frequencies, then up-mixing audio signals to create extra channels that output "intermediate" panning effects, as described below, and finally down-mixing the original and extra audio signals into a limited-channel audio set-up in a way that preserves the extracted panning information. The disclosed technique is particularly useful in down-mixing media content which contains multi-channel audio into stereo.

In some embodiments of the present invention, a processor automatically detects audio segments in pairs of audio channels of the multi-channel source which contain regions of panning. In the context of the present patent application and in the claims, the term "panning" refers to an effect in which a certain audio component gradually transitions from one audio channel to another i.e., gradually decreases in amplitude in one channel and increases in amplitude in another. Panning effects typically aim to create a realistic perception of spatial motion of the source of the audio component.

Such panning effects are typically dominated by certain audio frequencies (i.e., there are spectral components of the audio signals that undergo a panning effect). Following detection, the processor generates "virtual loudspeakers," which mimic new audio channels, on top of original channels, that contain signals that are "in-between" each two observed panning audio signals. The virtual channels and the original input audio channels together form an extended set of audio channels that retain the panning effect. These virtual channels are synthesized with the audio signals of the limited-channel audio set-up to create the limited-channel audio set-up. In a sense, the disclosed method creates a continuation of the movement, so instead of two-channel panning, the method allows creating panning which effectively mimics multiple channels.

In some embodiments, the processor receives multiple spectrograms derived from multiple respective individual audio signals of a multiple-channel set-up. The processor may derive, rather than receive, the spectrograms from the multiple-channel set-up. In the context of this disclosure, a spectrogram is a representation of the spectrum of frequencies of an audio signal intensity that varies with time (e.g., on a scale of tens of milliseconds).

In some embodiments, the processor is configured to identify the spectral components that undergo the panning effect by (i) receiving or generating multiple spectrograms corresponding to the audio input channels, (ii) dividing the spectrograms into spectral bands, (iii) computing amplitude functions for the spectral bands of the spectrograms, each amplitude function giving an amplitude of a respective spectral band in a respective spectrogram as a function of time, and (iv) identifying one or more pairs of the amplitude functions exhibiting the panning effect.

In some embodiments, identifying the pairs comprises identifying first and second amplitude functions, corresponding to a same spectral band in first and second spectrograms, wherein in the first amplitude function the amplitude increases monotonically over a time interval, and in the second amplitude function the amplitude decreases monotonically over the same time interval.

In some embodiments, the processor detects a panning effect between two audio channels by performing the following steps: (a) dividing each of the multiple spectrograms into a given number spectral bands, (b) computing, for each spectrogram, the same given number of spectral amplitudes as the given number as a function of time, by summing over time discrete amplitudes (i.e., summing frequency components of the slowly varying signal) in each respective spectral band of each spectrogram, (c) dividing each of the spectral amplitudes into segments having a predefined duration, (d) best fitting a linear slope to each spectral amplitude of the spectral amplitude segments, (e) creating a spectral amplitude slope (SAS) matrix for each of the multiple channels using the best fitted slopes, (f) dividing element by element all same ordered pairs of the SAS matrices to create a respective set of correlation matrices, (g) detecting panning segment pairs among the multiple channels using the correlation matrices.

Following the detection of the panning "events", as explained above, the processor extracts the audio segments that were detected as panning in the previous steps, and generates, e.g., by point-wise multiplication of every two panning channels, a new virtual channel (also termed hereinafter "virtual loudspeaker"), or more than one virtual channel, as described below. Finally, the processor recreates the limited channel set-up (e.g., a stereo set-up) that retains the panning effects in the output audio signals by applying directional filtration to the virtual channels and the multiple input audio channels.

In an embodiment, the processor generates one or more virtual channels, which together with the input audio channels form an extended set of audio channels that retain the identified panning effects. Then, the processor generates from the extended set a reduced set of output audio signals, fewer in number than the input audio signals, including recreating the panning effect in the output audio signals.

In some embodiments, the duration of segments, as well as all the other constants that appear throughout this application, are determined using a genetic algorithm that runs through various permutations of parameters to determine the best suitable ones. The genetic algorithm runs multiple times with various startup parameters and numerical examples of conditions and values, quoted hereinafter, that are the ones found best suitable using the genetic algorithm to the embodied data.

In an embodiment, the disclosed technique can be incorporated in a software tool which performs single-file or batch conversion of multi-channel audio content into stereo copies. In another embodiment, the disclosed technique can be used in hardware devices, such as smartphones, tablets, laptop computers, set-top boxes, and TV-sets, to perform conversion of content as it is being played to a user, with or without real-time processing.

Typically, the processor is programmed in software containing a particular algorithm that enables the processor to conduct each of the processor related steps and functions outlined above.

The disclosed technique lets a user experience the full immersive experience contained in the original multi-channel audio mix, over two channels only of, for example, popular consumer-grade stereo headphones. Although the embodiments described herein refer mainly to stereo application having two output audio channels, this choice is made purely by way of example. The disclosed techniques can be used in a similar manner to generate any desired number of output audio channels (fewer in number than the number of input audio channels of the multi-channel audio signal), while preserving panning effects.

Derivation of Spectrograms of a Multi-Channel Audio Source

FIG. 1 is a schematic block diagram of a workstation 200 configured to generate a limited-channel set-up comprising panning effects from a multi-channel audio signal, in accordance with an embodiment of the present invention. Workstation 200 comprises an interface 110 which, in the shown embodiment, is configured to receive multiple spectrograms derived from multiple respective individual audio channels of a multiple-channel set-up 101 comprising a limited-channel set-up, which by way of example comprises a 5.1 "surround" set-up comprising loudspeakers 102-108.

As seen in FIG. 1 row(I), panning effects 1001, 1002 and 1003, occur between channels 106 and 108, channels 104 and 105, and channels 108 and 102, of set-up 101, respectively. Panning sounds 1001, 1002, and 1003, may occur at different times. In general, there would be tens of such effects, spread over time, between different pairs of loudspeakers of set-up 101.

A processor 100 of workstation 200 is configured to identify such panning effect at certain spectral components in the multi-channel audio signal, and generate respectively to panning effects 1001, 1002 and 1003, virtual loudspeakers 1100, 1200 and 1300, seen in FIG. 1(II). Thus, at certain intermediate times, virtual loudspeakers 1100, 1200 and 1300 output audio signals that mimic panning effects as if were realized each by three loudspeakers rather than by a pair of loudspeakers.

As FIG. 1 row (II), the result of the disclosed method is up-scaling of set-up 101 into a multiple channel set-up 111, which may comprise tens of channels that mimic a real multiple loudspeaker system of tens of loudspeakers.

Processor 100 generates from set-up 111 a stereo channel set-up 222, seen as headphone pair 112 and 114 of FIG. 1 row (III), by directionally filtrating all the channels, real and virtual, of the multiple-channel set-up 111. For the directionally filtration, processor 100 may use HRTF filters. Finally, processor 100 outputs the generated stereo audio signal that captures the panning effects, for example by storing the stereo output signals in a memory 120.

Typically, processor 100 comprises a general-purpose processor, which is programmed in software to carry out the functions described herein. The software may be downloaded to the processor in electronic form, over a network, for example, or it may, alternatively or additionally, be provided and/or stored on non-transitory tangible media, such as magnetic, optical, or electronic memory.

Figure 2:
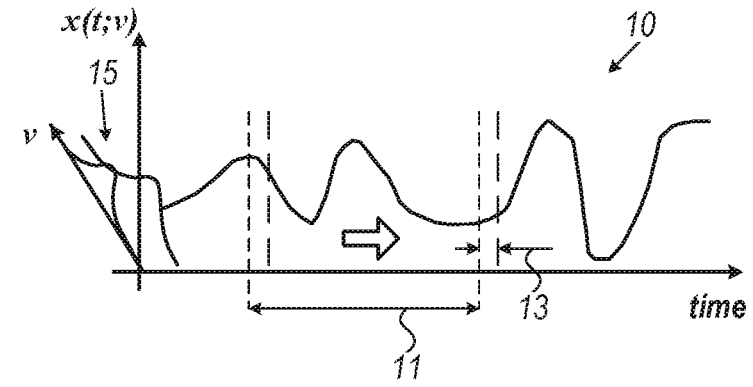
FIG. 2 is a graph that schematically shows plots of a single channel time-dependent bandwidth-limited audio signal, x(t; v), and its spectrogram, SP ($t_k$, $f_n$; v), in accordance with an embodiment of the present invention.
Figure 2:
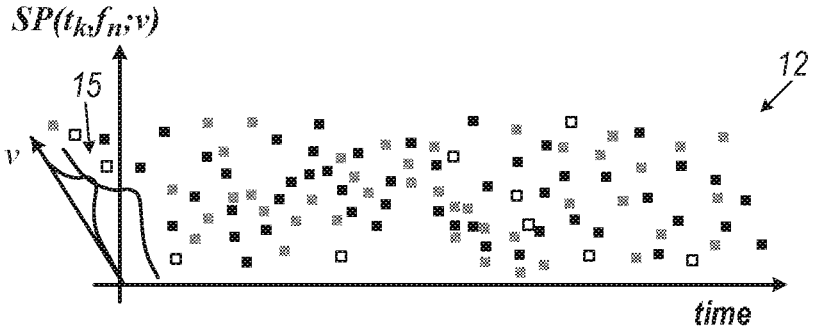

FIG. 2 is a graph that schematically shows plots of a single channel time-dependent bandwidth-limited audio signal 10, x(t; v), and its discrete spectrogram 12, SP ($t_k$, $f_n$; v), in accordance with an embodiment of the present invention. The variable v is the audio frequency, and it typically ranges between a few tens of Hz to a few tens of KHz.

In an embodiment, audio signals of a multi-channel audio source are extracted into individual audio channels, such as illustrated by x(t; v). The extraction process takes advantage of the fact that the order in which multiple audio channels appear inside an audio file is correlated with the designated loudspeaker through which the audio signal is to be played, according to standards that are common in the field. For example, the first audio channel in an audio mix that contains audio is meant to be played through the left loudspeaker in a home theater.

In some embodiments of the disclosed invention, a processor transforms the slowly varying sound amplitude of individual audio tracks with a time domain into the frequency domain. In an embodiment, the processor uses a Short Time Fourier Transform (STFT) technique. The STFT algorithm divides the signal into consecutive partially overlapping (e.g., shifted by a time increment 13) or nonoverlapping time windows 11 and repeatedly applies the Fourier transform to each window 11 across the signal.

In one embodiment, a discrete STFT, i.e., digitally transformed time domain signal x(t; v) of a given channel, is digitized over a time-window LΔt, L being an integer, k the discrete time variable, $k=t_k/\Delta t$, is given by:

$$STFT(k, n; v) = \sum_{i=0}^{L-1} x(i; v)\gamma^*(i-k)W_L^{-ni}. \quad \text{Eq. 1}$$

In Eq. 1, n is the frequency bin, $n=L\Delta t \cdot f_n$, W is the Fourier kernel, and γ* is a symmetric window, e.g., a Hanning window, trapezoid, Blackman, or other type of window known in the art.

In an embodiment, the STFT algorithm may be used with 500 msec time windows and 50% overlap between time windows. In another embodiment, the SIFT is used with different time window lengths and different overlap ratios between the time windows.

Smoothing the STFT may be attained by increasing the degree of overlapping of the time windows. The STFT spectrogram, that is, the discrete energy distribution over time and frequency, is defined as:

$$SP(k, n; v) = \left|\sum_{i=0}^{L-1} x(i; v)\gamma^*(i-k)W_L^{-ni}\right|^2, \quad \text{Eq. 2}$$

where SP(k, n; v) can be written also as $SP(t_k, f_n)$ using the above relations $t_k=k\Delta t$ and $f_n=n/L\Delta t$.

In FIG. 2, the frequency components $f_n$ of the slowly varying sound intensity in SP ($t_k$, v) are shown in a grey-scale coding for clarity of presentation. Furthermore, SP ($t_k$, $f_n$; v) is shown as a very sparse scatter plot, for clarity of presentation of the concept, whereas in practical applications, SP($t_k$, $f_n$; v) is sampled more densely and is smoothed.

Detection of Audio Panning in a Multi-channel Source

Figure 3:
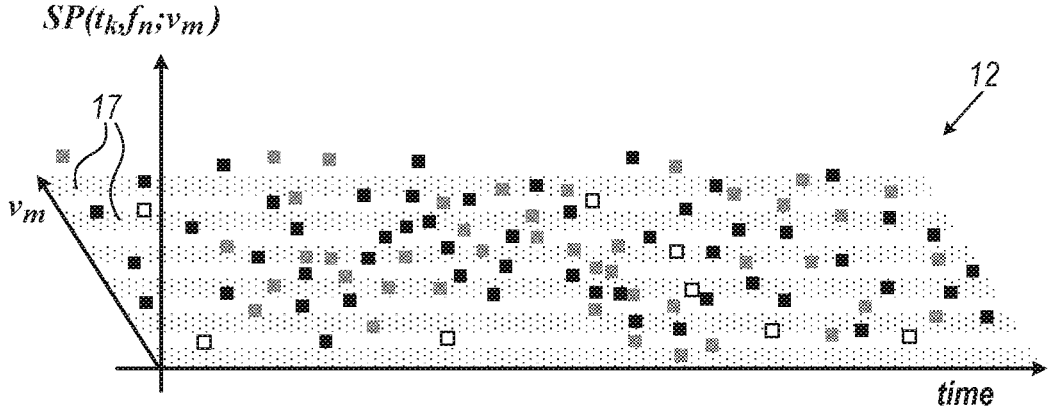
FIG. 3 is a graph that schematically shows the spectrogram of FIG. 2, SP ($t_k$, $f_n$; v), divided into spectral bands, $v_m$, SP($t_k$, $f_n$; $v_m$), in accordance with an embodiment of the present invention.

FIG. 3 is a graph that schematically shows the spectrogram of FIG. 2, SP($t_k$, $f_n$;v), divided into spectral bands 17, $v_m$, SP($t_k$, $f_n$;$v_m$), in accordance with an embodiment of the present invention. The index m runs over the created set of spectral bands 17.

In some embodiments, the spectrogram is divided into equally wide spectral bands 17, as exemplified by FIG. 3. In one embodiment, these spectral bands have a width of 24 Hz. In another embodiment, a different width is used for the spectral bands. In yet another embodiment, spectrogram 12 is divided into uneven spectral bands, such that lower frequencies are divided into spectral bands that are different in width than those with higher frequencies. Such a division can be derived, for example, using the aforementioned genetic algorithm.

For each spectral band, the sum over time of discrete amplitudes within the spectral hand over time is given by S (k; m) (16):

$$S(k; m) = \sum_{n\in[m\cdot P+1,\ldots(m+1)\cdot P]} SP(k, n; m),\ 1 \le m \le M, \quad P = \left[\frac{N}{M}\right] \quad \text{Eq. 3}$$

In Eq. 3, m is the spectral band index running up to a number M of the total spectral bands, each spectral band comprising P frequencies and N being the total number of discrete spectral frequencies in the spectrogram. The result of Eq. 3 is shown in FIG. 4.

Figure 4:
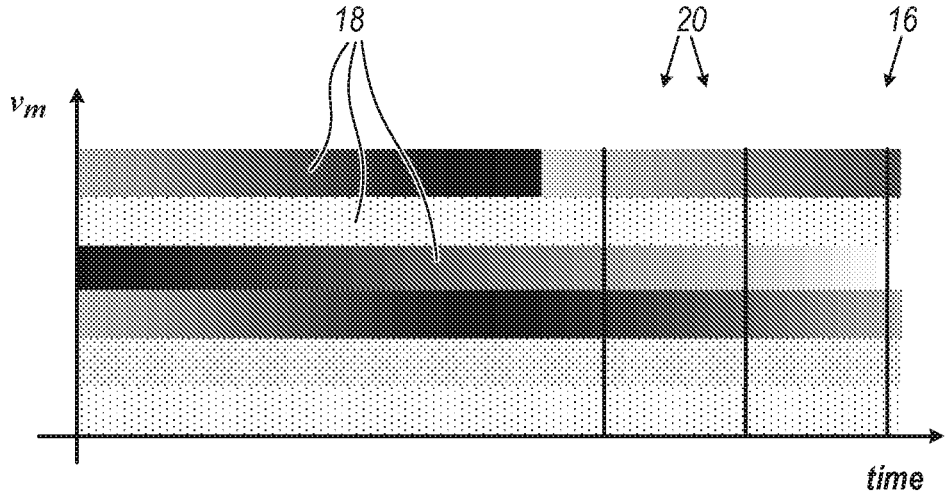
FIG. 4 is a schematic, grey-level illustration of spectral amplitudes as a function of time, in accordance with an embodiment of the present invention.

FIG. 4 is a schematic, grey-level illustration of spectral amplitudes 18 as a function of time, in accordance with an embodiment of the present invention. Essentially, the process creates, for each of the audio channels and for each spectral band within each channel, graphs of spectral power over time. In FIG. 4, a darker shade corresponds to higher sound intensity. As seen during some time-segments, the signal may gradually increase in amplitude, and in others diminish. This time dependence of amplitude per each spectral band per different channel is subsequently utilized, as described below, to create audio panning effects.

Typically, however, sound intensity may increase or decrease in a nonlinear fashion, which makes panning difficult.

As seen in FIG. 4, in an embodiment, spectral bands 18 are segmented into time blocks 20. In an embodiment, these time blocks are 500 milliseconds in length, a duration optimized, for example, by the aforementioned genetic algorithm. In another embodiment, a different length is used for each block.

To overcome the difficulty with panning nonlinearly varying spectral amplitudes of sound, the spectral amplitudes are each linearized over a respective time-block 20. For each block 20, denoted as S', comprising N elements, a linear regression method is used to analyze the change in maximal amplitude over time by computing least square (LS) coefficients α and $$\beta = \frac{N\cdot\sum_{k\in S'} k\cdot S'(k) - \sum_{k\in S'} k\cdot\sum_{k\in S'} S'(k)}{N\cdot\sum_{k\in S'} k^2 - (\sum_{k\in S'} S'(k)^2)} \quad \text{Eq. 4}$$

$$\alpha = \frac{\sum_{k\in S'} S'(k) - \beta\cdot\sum_{k\in S'} k}{N}$$

Based on computed coefficients α and β, the LS interpolated values are given by the linear line whose equation is:

$$LS(k)=\beta\cdot k+\alpha \quad \text{Eq. 5}$$

Overall, the above regression step gives the required slope of the linearized spectral amplitude in each predefined segment duration that smooths the mean spectral amplitude over time and clears out background noise. The slope measures whether, for a particular spectral band, for a particular time period (i.e., duration of a time block), sound amplitude has either risen or fallen. Examples of resulting spectral amplitudes are shown in FIG. 5.

In general, a nonlinear fit may be used, and in such cases the slope may be generalized by a local derivative of the nonlinear fitting curve. To generate slope values discrete in time, the derivative may be, for example, averaged over each time period, or an extremum value of the derivative over each time period may be used.

Synthesis of 3D Audio from Limited-Channel Surround Sound

Figure 5:
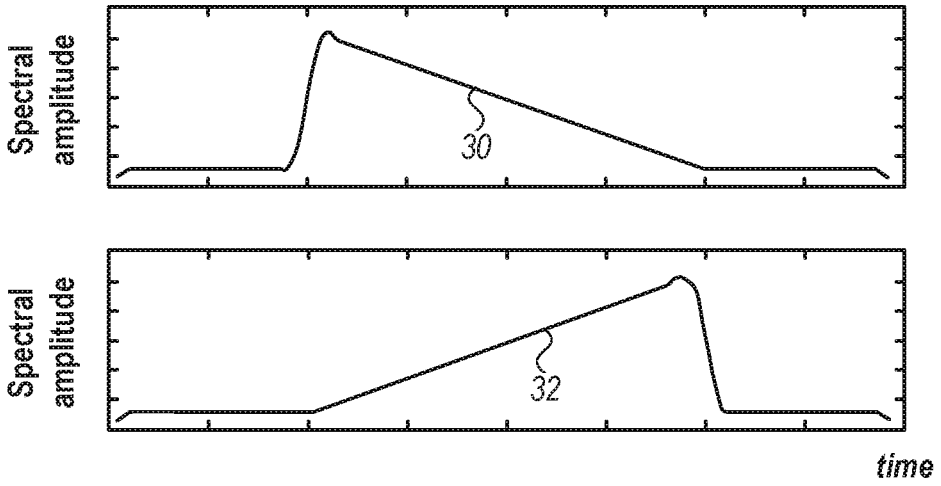
FIG. 5 is a graph that schematically shows plots of time segments of linearly varying spectral amplitudes from two different audio channels, in accordance with an embodiment of the present invention.

FIG. 5 is a graph that schematically shows plots of time-segments of linearly varying spectral amplitudes 30 and 32 from two different audio channels, in accordance with an embodiment of the present invention. Spectral amplitudes 30 and 32 are derived by processor 22 using Eq. 4. As seen by the example shown in FIG. 5, over a given duration, derived, for example, by the aforementioned genetic algorithm, spectral amplitudes 30 linearly diminishes in amplitude while at a same time spectral amplitude 32 linearly increases.

Spectral amplitude of different audio channels, such as amplitudes 30 and 32, that coincide in time, that belong to a same spectral band, and exhibit anti-correlative change in amplitude, are of specific interest to embodiments of the present invention, as such pairs of spectral amplitude capture the essence of the panning effect.

In a next processing step, the processor creates, for each certain spectral band and a segment in time, a matrix in which each element is the slope of the spectral amplitude of that band (named hereinafter, "slope matrix"). The slope matrices which originated from the individual audio tracks are then divided by one another, element by element (point-wise). For example, the slope matrix for the "left" channel is divided by the slope matrix for the "rear left" channel. In the resultant matrix, cells which in one embodiment contain the number (−1) or, in another embodiment, ((−1)+α), where α is a positive constant which represents algorithmic flexibility which accounts for spectral noise, are cells which represent regions (in both time and frequency) of perfect panning of a particular spectral band between the two audio channels. This condition occurs when, in one channel for a particular spectral band and a particular time period, the amplitude has risen while in another channel, for the same spectral band and time period, the amplitude has fallen, or vice-versa, and the rate by which the amplitude changed in each of the audio channels was similar (e.g., up to α).

In the next step, a scan of the divided slope matrix is performed to locate the longest period of time over which panning was detected, by locating regions of consecutive panning over time in a particular spectral band or bands. In an embodiment, a scan is performed to locate the longest consecutive panning regions in time for each spectral band. The timing boundaries of these audio regions are marked and extracted and used for the creation of a virtual loudspeaker, as described in FIG. 6.

Creating a virtual channel means that after the panning detection was made, these time codes are used with the original audio channels (in the time domain), i.e., with any two audio channels between which panning effect was detected, and perform a point-wise multiplication of these audio channels pairs—but only for the regions in time recognized as panning. This creates the virtual channel.

Figure 6:
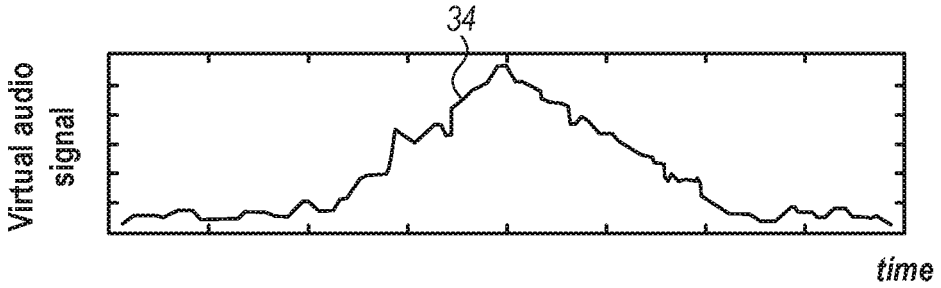
FIG. 6 is a graph that schematically shows an audio segment of a virtual loudspeaker, with the audio segment generated from the two channels that comprise the spectral amplitudes of FIG. 5, in accordance with an embodiment of the present invention.

FIG. 6 is a graph that schematically shows an audio segment 34 of a virtual loudspeaker, with the audio segment generated from the two channels that comprise spectral amplitudes 30 and 32 of FIG. 5, in accordance with an embodiment of the present invention. Audio signal 34 was derived by point-wise multiplication in the time domain of the full audio signals in which spectral amplitudes 30 and 32 were detected, i.e., in an audio region that was detected as including panning effect. In this way audio signal 34 creates an intermediate channel, or a virtual loudspeaker. As the actual audio signals comprising spectral amplitudes 30 and 32 are varying in time in a complicated manner, so does audio-signal 34. Yet, the generated virtual panning effect (triangular shape of sound) is still a dominant enough feature of audio signal 34. In general, other point-wise math operations e.g., intersection, summation, may yield an intermediate channel of value.

A similar process can be used to create multiple virtual loudspeakers between any two given audio sources, which will create audio panning consecutively appearing in multiple locations, as illustrated below in FIG. 7.

FIG. 7 is a diagram that schematically shows one or more virtual loudspeakers generated from two original audio sources, in accordance with an embodiment of the present invention. In general, any combination of audio sources and loudspeakers can be used by the disclosed algorithm to generate virtual loudspeakers. Row (i) shows, by way of example, two original loudspeakers, a Left loudspeaker 40 and a Right loudspeaker 50, which can be those of stereo headphones. Using the disclosed technique, a processor generates a virtual Center loudspeaker 44, seen in Row (ii) of FIG. 7.

A mimic of a multi-channel loudspeaker system comprising four loudspeakers is shown in Row (iii) with the two original, Left and Right loudspeakers, and two virtual loudspeakers, a Center-Left virtual loudspeaker 42 and a Center-Right virtual loudspeaker 46. As noted above, more virtual loudspeakers can be generated as deemed necessary for further enhancing user experience of "surround" audio.

Finally, after obtaining "virtual loudspeakers," such as loudspeakers 42, 44, and 46 of FIG. 7, which represent the identification of regions containing audio panning and themselves containing some of the detected panning as "intermediate" panning channels, the disclosed technique applies filters to the entire set of channels (e.g., in case of row (iii) of FIG. 7, to channels 40, 42, 46, and 50) such as HRTF filters, to give a psycho-acoustic feeling of direction to each of the loudspeakers.

For example, an HRTF filter obtained from a recording at an angle of 300 degrees can be applied to the Left channel, an HRTF filter obtained from recording at an angle of 60 degrees can be applied to the Right channel, an HR filter obtained from recording at an angle of 330 degrees can be applied to the newly created audio channel identified in FIG. 7 row (iii) as "Center-Left," and an HRTF filter obtained from recording at an angle of 30 degrees can be applied to the newly created audio identified in FIG. 7 row (iii) as "Center-Right" channel. (Values of degrees in this example assume clock-wise angles relative to a listener facing forward).

In an embodiment, the application of HRTF filters can be done by applying a convolution:

$$y_{left}(s) = \sum_{j=-\infty}^{\infty} x(j)h_{left}(s-j) \qquad \text{Eq. 6}$$

$$y_{right}(s) = \sum_{j=-\infty}^{\infty} x(j)h_{right}(s-j)$$

In Eq. 6, γ are the processed data, s is the discrete time variable, {x(j)} is a chunk of the audio samples being processed, and h is the kernel of the convolution representing the impulse response of the appropriate HRTF filter.

FIG. 8 is a flow chart that schematically illustrates a method for generating a virtual loudspeaker that induces a psycho-acoustic feeling of direction and motion, in accordance with an embodiment of the present invention. The algorithm according to the presented embodiment carries out a process that begins at a spectrograms-receiving step 70, in which multiple spectrograms are received in an interface 10 of a processor 100. The spectrograms are derived from multiple respective individual audio channels of a multiple-channel set-up such as a 5.1 set-up.

Next, processor 100 divides each of the multiple spectrograms into a given number of spectral bands, each having a bandwidth derived by the aforementioned genetic algorithm, at a spectrograms-division step 72. At a next computing step 74, processor 100 computes, for each spectrogram, the same number of spectral amplitudes as the given number as a function of time, by summing over time discrete amplitudes in each respective spectral band of each spectrogram. Then, processor 100 divides each of the spectral amplitudes into temporal segments having a predefined duration derived by the aforementioned genetic algorithm, at a spectral-amplitudes segmenting step 76. Next, processor 100 best fits a linear slope to each spectral amplitude of the spectral amplitude segments, at a slope-fitting step 78.

Using the best fitted slopes, processor 100 creates (e.g., populates) a spectral amplitude slope (SAS) matrix for each of the multiple channels, at a slope-fitting step 80.

Next, processor 100 divides, element by element, all same ordered pairs of the SAS matrices to create a respective set of correlation matrices, at a correlation-matrix derivation step 82. Using the correlation matrices, processor 100 detects panning segment pairs among the multiple channels, at a panning detection step 84. Processor 100 detects the panning segment pairs by finding, in the correlation matrices, elements that are larger or equal (−1) with a tolerance a, as described above.

Using at least part of the detected panning segment pairs, processor 100 creates the one or more virtual channels comprising a point-wise product of those panning segment pairs, at a virtual-channels creating step 86.

At a spatial filtration step 88, processor 100 applies filters, such as HRTF filters, to an entire set of channels (i.e., virtual and original) to give a psycho-acoustic feeling of direction to each of the virtual and stereo loudspeakers. Finally, at a channel combining step 90, the processor combines (e.g., by first applying directional filtration to) the virtual and original channels to create a synthesized two-channel stereo set-up comprising panning information from the multi-channel set-up.

Although the embodiments described herein mainly address processing of audio signals, the methods described herein can also be used, mutatis mutandis, in computer graphics and animation, to detect motion in pairs of video frames and to dynamically create intermediate video frames thereby effectively increasing the video frame rate.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. A method, comprising:

receiving a multi-channel audio signal comprising multiple input audio channels that are configured to play audio from multiple respective locations relative to a listener;

identifying among the multiple input audio channels in the multi-channel audio signal one or more spectral components that undergo a panning effect, by:

receiving or generating multiple spectrograms corresponding to the multiple input audio channels;

dividing the multiple spectrograms into spectral bands; and identifying in the multiple spectrograms:

(i) a first audio channel that, within a given spectral band, increases monotonically in amplitude over a given time interval; and (ii) a second audio channel that, within the same given spectral band, decreases monotonically in amplitude over the same given time interval;

generating one or more virtual channels, which together with the multiple input audio channels form an extended set of audio channels that retain the identified panning effect;

generating from the extended set a reduced set of output audio signals, fewer in number than the multiple input audio channels, wherein generating the reduced set of output audio signals includes recreating the panning effect in the output audio signals; and outputting the reduced set of output audio signals to the listener.

2. The method according to claim 1, wherein generating the reduced set of output audio signals comprises synthesizing left and right audio channels of a stereo signal.

3. The method according to claim 1, wherein recreating the panning effect in the output audio signals comprises applying directional filtration to the one or more virtual channels and the multiple input audio channels.

4. The method according to claim 1, wherein dividing the multiple spectrograms into the spectral bands comprises producing at least two spectral bands having different bandwidths.

5. A system, comprising:

an interface, which is configured to receive a multi-channel audio signal comprising multiple input audio channels that are configured to play audio from multiple respective locations relative to a listener; and a processor, which is configured to:

identify among the multiple input audio channels in the multi-channel audio signal one or more spectral components that undergo a panning effect, by:

receiving or generating multiple spectrograms corresponding to the multiple input audio channels;

dividing the multiple spectrograms into spectral bands; and identifying in the multiple spectrograms:

(i) a first audio channel that, within a given spectral band, increases monotonically in amplitude over a given time interval; and (ii) a second audio channel that, within the same given spectral band, decreases monotonically in amplitude over the same given time interval;

generate one or more virtual channels, which together with the multiple input audio channels form an extended set of audio channels that retain the identified panning effect;

generate from the extended set a reduced set of output audio signals, fewer in number than the multiple input audio channels, wherein generating the reduced set of output audio signals includes recreating the panning effect in the output audio signals; and output the reduced set of output audio signals to the listener.

6. The system according to claim 5, wherein the processor is configured to generate the reduced set of output audio signals by synthesizing left and right audio channels of a stereo signal.

7. The system according to claim 5, wherein the processor is configured to recreate the panning effect in the output audio signals by applying directional filtration to the one or more virtual channels and the multiple input audio channels.

8. The system according to claim 5, wherein the processor is configured to divide the multiple spectrograms into the spectral bands by producing at least two spectral bands having different bandwidths.

* * * * *